US011192708B2

(12) United States Patent
Kitano et al.

(10) Patent No.: US 11,192,708 B2
(45) Date of Patent: Dec. 7, 2021

(54) THERMALLY INSULATED CONTAINER

(71) Applicant: Panasonic Intellectual Property Management Co., Ltd., Osaka (JP)

(72) Inventors: Tomoaki Kitano, Nara (JP); Masahiro Kagimoto, Shiga (JP); Toshiaki Hirano, Shiga (JP); Hideji Kawarazaki, Osaka (JP); Shinya Kojima, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 11 days.

(21) Appl. No.: 16/548,878

(22) Filed: Aug. 23, 2019

(65) Prior Publication Data

US 2020/0079575 A1 Mar. 12, 2020

(30) Foreign Application Priority Data

Sep. 6, 2018 (JP) ..... JP2018-166521

(51) Int. Cl.
*B65D 81/38* (2006.01)
*B65D 81/18* (2006.01)

(52) U.S. Cl.
CPC ..... *B65D 81/3825* (2013.01); *B65D 81/18* (2013.01); *B65D 81/3813* (2013.01)

(58) Field of Classification Search
CPC ..... B65D 81/3825; B65D 81/3813; B65D 81/18; B65D 81/3883; A61J 1/165; F25D 3/08
See application file for complete search history.

(56) References Cited

U.S. PATENT DOCUMENTS 4,322,954 A * 4/1982 Sheehan ..... F25D 3/08 62/371
4,344,300 A * 8/1982 Taylor ..... A45C 11/20 62/371
4,809,522 A * 3/1989 deNevers ..... B65D 81/3886 62/372
5,875,646 A * 3/1999 Rich ..... F25D 3/08 62/457.3
8,517,211 B2 * 8/2013 Brown ..... F25D 23/028 220/831
2011/0174166 A1 * 7/2011 Sparacio ..... H05B 1/0227 99/453

FOREIGN PATENT DOCUMENTS

JP 2013-010523 1/2013

* cited by examiner

*Primary Examiner* — Andrew T Kirsch
(74) *Attorney, Agent, or Firm* — Hamre, Schumann, Mueller & Larson, P. C.

(57) ABSTRACT

A thermally insulated container includes a container main body having a storage section and an opening, a lid body that covers the opening of the container main body, and an inner box stored in the storage section. The lid body has a convex portion arranged along a periphery of the opening of the container main body and protruding toward an inside of the storage section when the lid body covers the opening. The convex portion faces the inner box, with a gap between the convex portion and the inner box when the lid body covers the opening.

15 Claims, 11 Drawing Sheets

THERMALLY INSULATED CONTAINER

BACKGROUND

1. Technical Field

The present disclosure relates to a thermally insulated container suitable to manage a content of the container at a desired temperature.

2. Description of the Related Art

Conventionally, a thermally insulated container is used to, for example, deliver a content while managing the content at a desired temperature. For example, a material such as a vacuum insulating material is used as a material for this thermally insulated container, which is configured to maintain the container in a desired temperature range (see, for example, Unexamined Japanese Patent Publication No. 2013-10523).

When the content is, for example, an investigational drug, the drug is required to be strictly managed in a specific temperature range (for example, 2° C. to 8° C.). In addition, in order to enable delivery taking a long time, an internal temperature of a thermally insulated container is required to stay longer in the specific temperature range. In order to satisfy these requirements, it is necessary to further improve a thermal insulation property of the thermally insulated container.

SUMMARY

The present disclosure provides a thermally insulated container.

A thermally insulated container according to the present disclosure includes a container main body having a storage section and an opening, a lid body that covers the opening of the container main body, and an inner box stored in the storage section. The lid body has a convex portion arranged along a periphery of the opening of the container main body and protruding toward an inside of the storage section when the lid body covers the opening. The convex portion faces the inner box, with a gap between the convex portion and the inner box when the lid body covers the opening.

This arrangement can extend a heat penetration path from outside the thermally insulated container. In addition, reducing a contact area between the inner box and the lid body can reduce an influence of heat between the inner box and the container main body. This can improve a heat insulation performance of the thermally insulated container.

DETAILED DESCRIPTION

Figure 1:
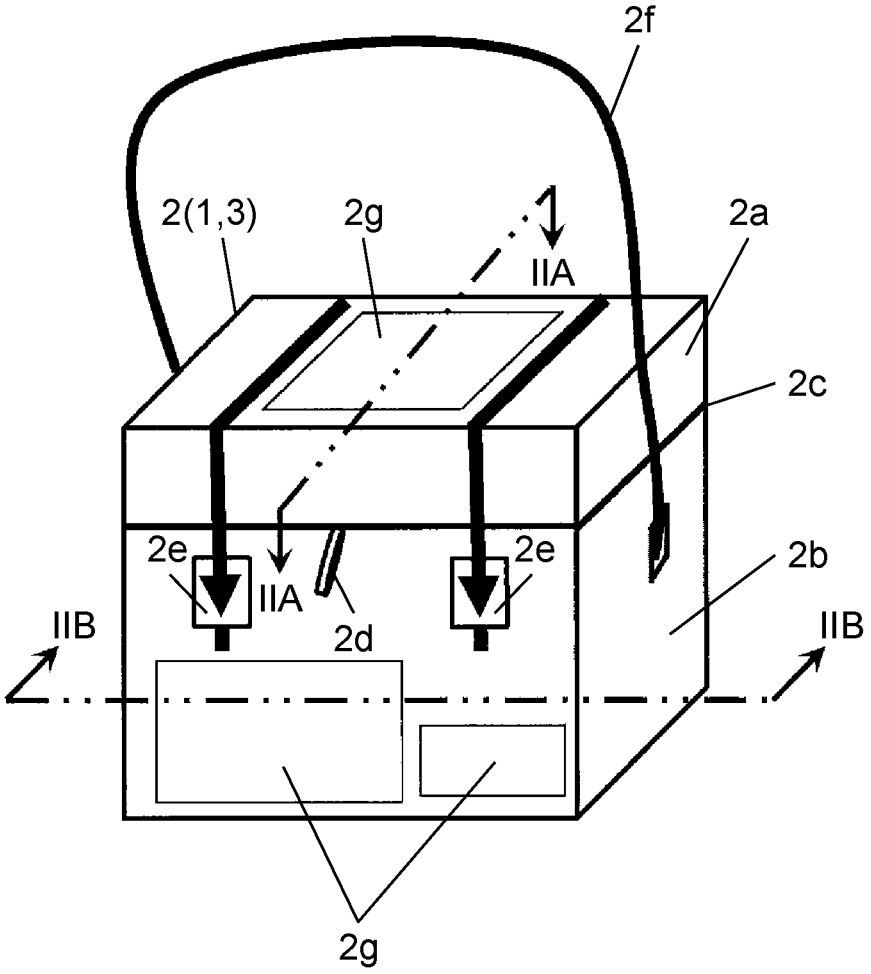
FIG. 1 is a perspective view showing a state in which a thermally insulated container according to a first exemplary embodiment of the present disclosure is covered with a container case.

A thermally insulated container according to one aspect to the present disclosure includes a container main body having a storage section and an opening, a lid body that covers the opening of the container main body, and an inner box stored in the storage section. The lid body has a convex portion arranged along a periphery of the opening of the container main body and protruding toward an inside of the storage section. The convex portion faces the inner box with a gap between the convex portion and the inner box.

This arrangement can extend a heat penetration path from outside the thermally insulated container. In addition, reducing a contact area between the inner box and the lid body can reduce an influence of heat transfer between the inner box and the thermally insulated container. This can improve a heat insulation performance of the thermally insulated container.

A thermally insulated container according to another aspect of the present disclosure may be configured such that a convex portion is in contact with an inner peripheral surface of the storage section.

This arrangement can improve a heat insulation performance of the thermally insulated container by suppressing penetration of heat from outside of the container main body.

A thermally insulated container according to still another aspect of the present disclosure, an inner box may include a heat storage material.

This arrangement improves the heat insulation performance of the inner box. In addition, having a gap between the convex portion of the lid body and the heat storage material of the inner box can suppress heat conduction and prolong a heat retention effect of the heat storage material.

In a thermally insulated container according to still another aspect of the present disclosure, an inner box may include a wall body having a packaging member, and a heat-transfer body and a heat storage material that are stored in the packaging member. The heat storage material may be disposed closer to an outer surface of the inner box than the heat-transfer body is.

Packaging the heat-transfer body and the heat storage material can prevent the heat-transfer body and the heat storage material from being positionally shifted. In addition, disposing the heat storage material closer to the outer surface of the inner box than the heat-transfer body is allows the heat-transfer body to make an internal temperature distribution of the inner box more uniform.

In a thermally insulated container according to still another aspect of the present disclosure, a wall body includes at least two wall bodies adjacent to each other. The at least two wall bodies may be coupled to each other, at each one side adjacent to each other, with at least one of a detachable fixing member and the packaging members of the two wall bodies.

This arrangement makes the inner box foldable and allows the inner box to be easily assembled. Accordingly, the heat storage material can be cooled while the inner box is folded. This makes it possible to improve workability at the time of cooling as compared with a case of taking out the heat storage materials one by one from the inner box and cooling each material.

In a thermally insulated container according to still another aspect of the present disclosure, a portion of a packaging member that covers a heat storage material may be a transparent resin.

This arrangement makes it possible to easily visually check a molten state of a heat storage material through a packaging member.

A thermally insulated container according to still another aspect of the present disclosure may further include a physical quantity sensor disposed inside an inner box.

This arrangement makes it possible to monitor and manage an environmental situation inside the inner box.

In a thermally insulated container according to still another aspect of the present disclosure, an inner box fixing member for fixing an inner box may be disposed on a bottom portion of a storage section of a container main body.

This arrangement can prevent the inner box from moving in the thermally insulated container due to vibrations and the like at the time of delivery and the like.

In a thermally insulated container according to still another aspect of the present disclosure, an inner box fixing member may be disposed between an inner box and a bottom portion of a storage section, and has a first surface in contact with the inner box and a second surface facing the bottom portion of the storage section. The inner box fixing member may have a through hole penetrating from the first surface to the second surface.

This arrangement can further reduce a contact surface between the inner box and the inner box fixing member and suppress heat transfer between the inner box and the inner box fixing member, thereby suppressing a melting speed of a heat storage material.

Exemplary embodiments of the present disclosure will be described below with reference to the accompanying drawings.

First Exemplary Embodiment

[1. Overall Configuration]

Figure 2A:
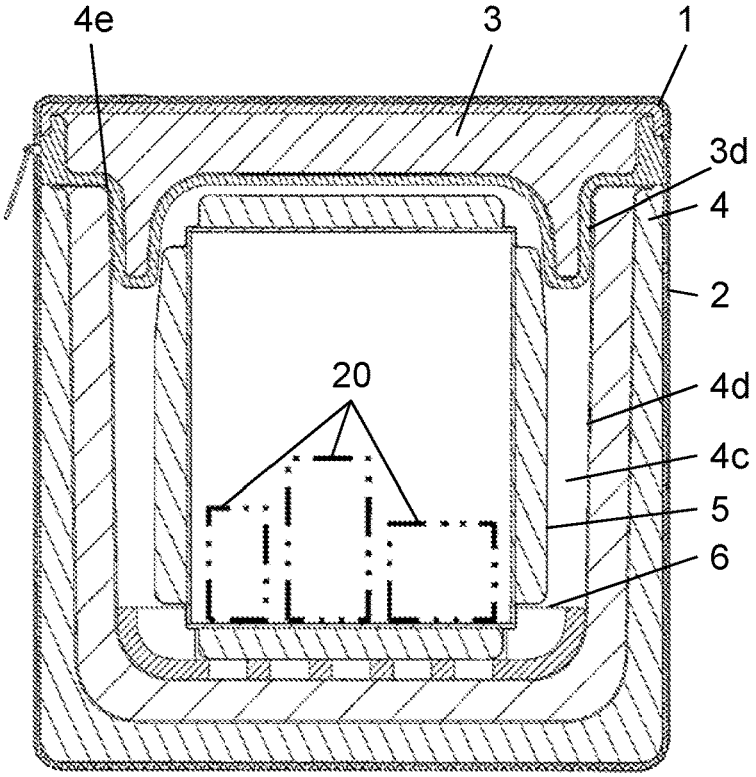
FIG. 2A is a sectional view taken along line IIA-IIA of FIG. 1.
Figure 2B:
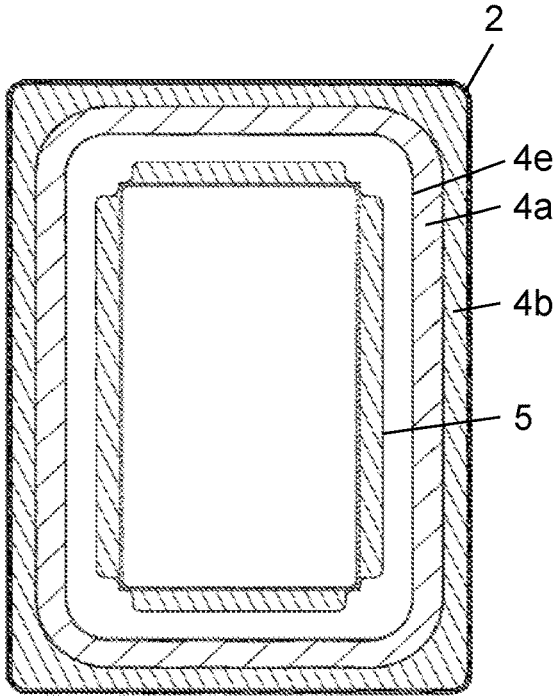
FIG. 2B is a sectional view taken along line IIB-IIB of FIG. 1.
Figure 3:
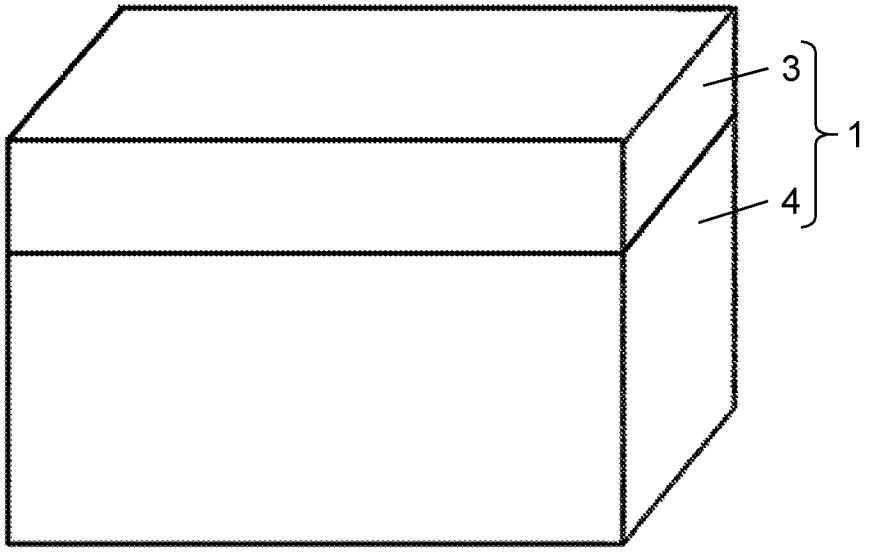
FIG. 3 is a perspective view showing the thermally insulated container according to the first exemplary embodiment.

FIG. 1 is a perspective view showing a state in which a thermally insulated container according to a first exemplary embodiment of the present disclosure is covered with a container case. FIG. 2A is a sectional view taken along line IIA-IIA of FIG. 1. FIG. 2B is a sectional view taken along line IIB-IIB of FIG. 1. FIG. 3 is a perspective view showing the thermally insulated container according to the first exemplary embodiment.

As shown in FIG. 1, thermally insulated container 1 according to this exemplary embodiment is stored in container case 2. This makes it easy to carry a content.

Container case 2 includes case lid body 2*a* and case main body 2*b*. Case lid body 2*a* and case main body 2*b* are configured to be closed with case fastener 2*c*. By this configuration, thermally insulated container 1 can be covered and a situation that thermally insulated container 1 and container case 2 are detaching from each other can be prevented. In addition, this configuration can prevent lid body 3 of thermally insulated container 1 from unintentionally opening.

The fastener is provided with case fastener grip 2*d* to facilitate opening and closing the fastener.

Case lid fixtures 2*e* are disposed at two portions of container case 2. This makes it possible to reliably close thermally insulated container 1. In addition, document storage sections 2*g* are arranged on a side surface and a top surface of container case 2. Note that document storage sections 2*g* can be provided at arbitrary positions on container case 2. Case handle 2*f* is provided such that case handle 2*f* is supported by two opposing side surfaces of container case 2. This allows a user to easily carry the container case by holding case handle 2*f*.

As shown in FIGS. 2A and 3, thermally insulated container 1 includes container main body (main body) 4 and lid body 3. As shown in FIGS. 2A and 2B, inner box 5 (to be described later) is disposed inside container main body 4.

[2. Lid Body]

Lid body 3 will be described next.

Figure 4:
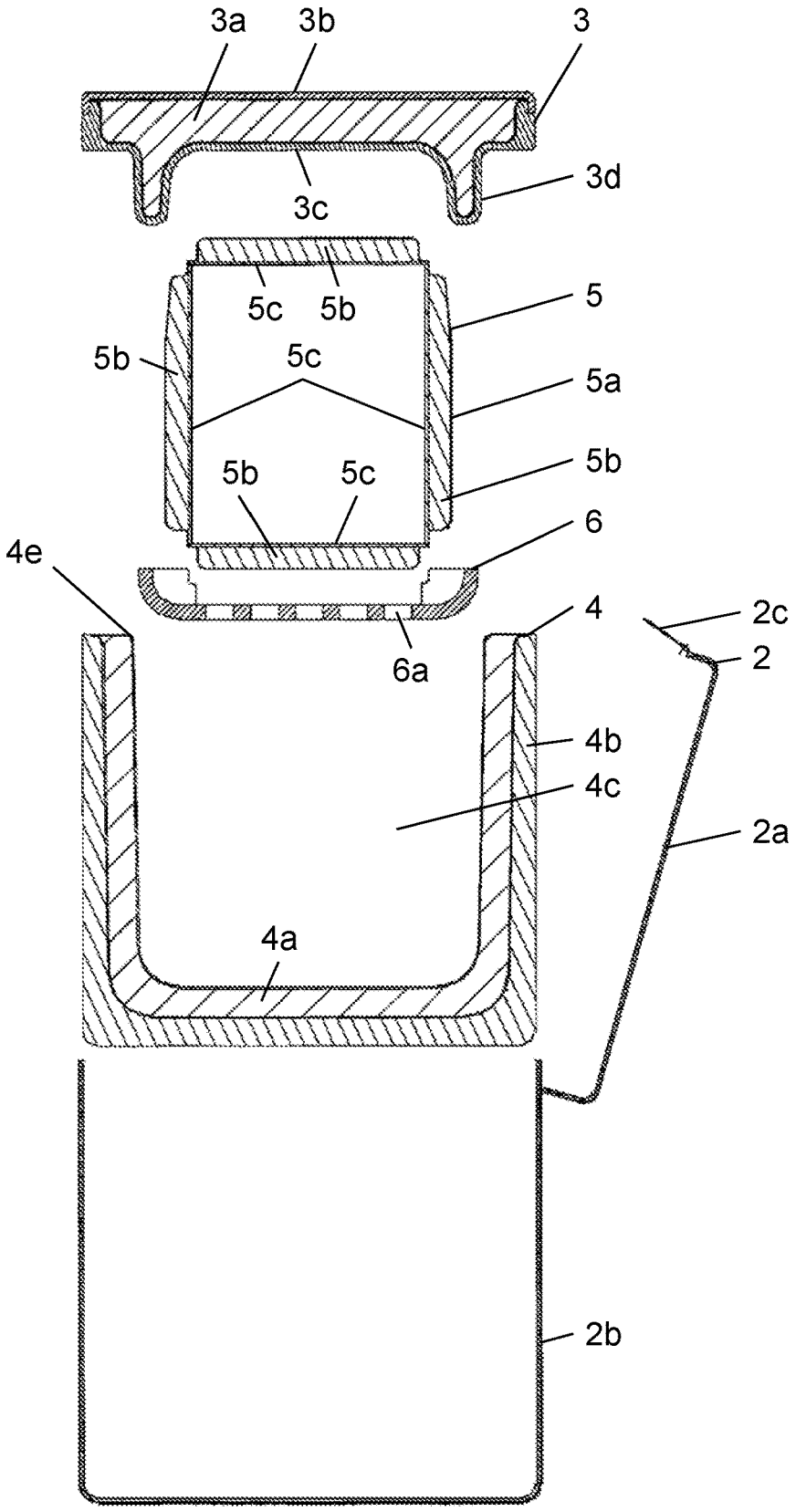
FIG. 4 is an exploded sectional view showing the thermally insulated container covered with the container case shown in FIG. 1.
Figure 5A:
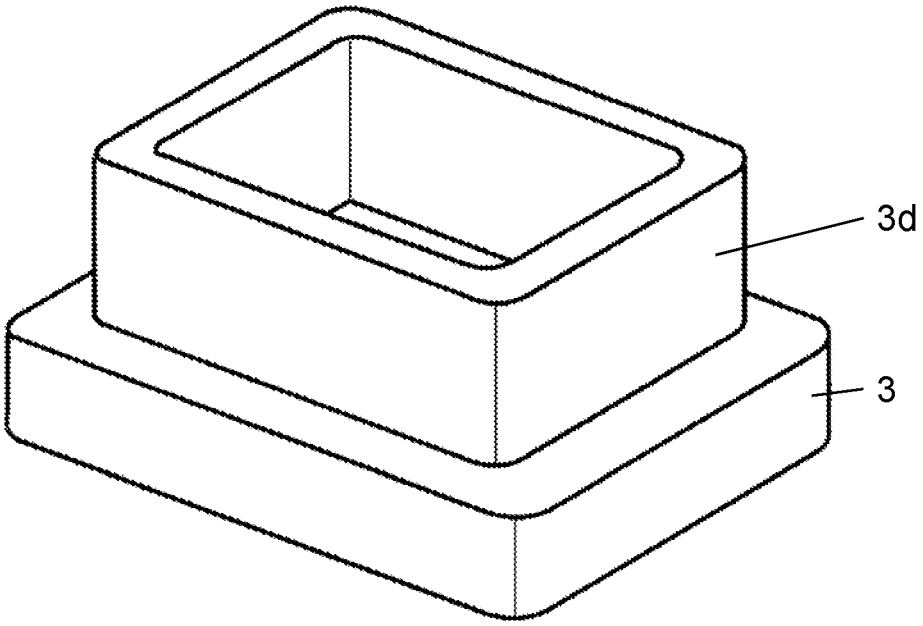
FIG. 5A is a perspective view showing a lid body of the thermally insulated container according to the first exemplary embodiment.
Figure 5B:
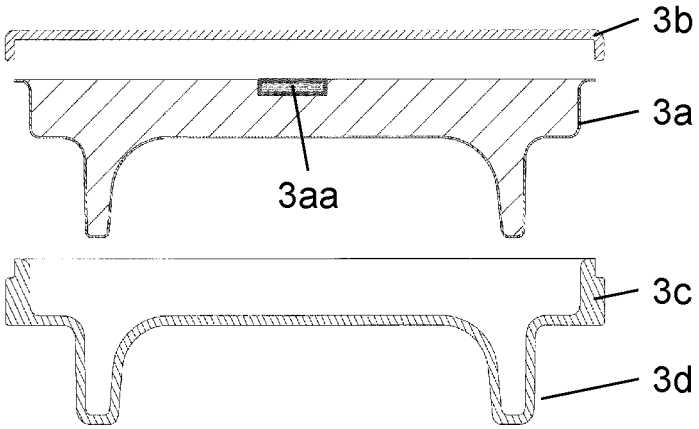
FIG. 5B is an exploded sectional view showing the lid body shown in FIG. 5A.
Figure 6:
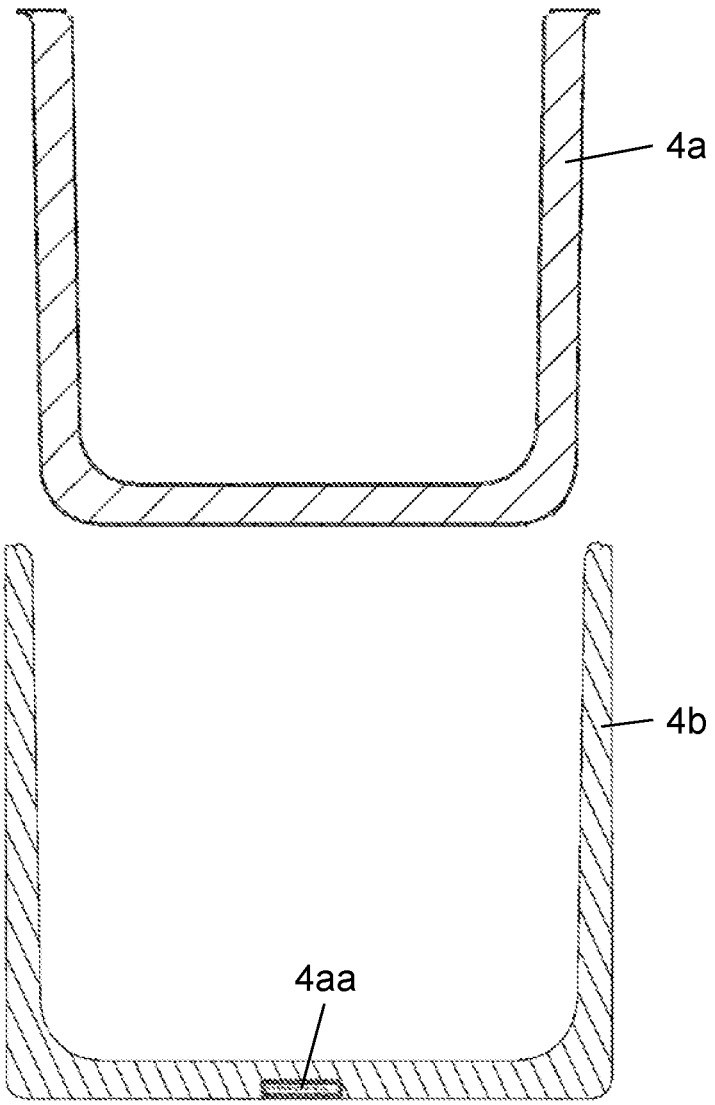
FIG. 6 is an exploded sectional view showing a container main body of the thermally insulated container according to the first exemplary embodiment.

FIG. 4 is an exploded sectional view showing the thermally insulated container covered with the container case shown in FIG. 1. FIG. 5A is a perspective view showing a lid body of the thermally insulated container according to the first exemplary embodiment. FIG. 5B is an exploded sectional view showing the lid body shown in FIG. 5A. FIG. 6 is an exploded sectional view showing a container main body of the thermally insulated container according to the first exemplary embodiment.

As shown in FIG. 4, lid body 3 is disposed to cover opening 4*e* of storage section 4*c* of container main body 4. As shown in FIGS. 5A and 5B, lid body 3 has convex portion 3*d*.

As shown in FIG. 5B, lid body 3 is formed by hermetically sealing vacuum heat insulation housing 3*a* with lid outside protective case 3*b* and lid inside protective case 3*c*. Lid absorbent 3*a* a for absorbing a remaining gas is disposed inside vacuum heat insulation housing 3*a* of lid body 3.

As shown in FIG. 6, container main body 4 includes main body vacuum heat insulation housing 4*a* and main body protective case 4*b*. Main body absorbent 4*a* a is disposed inside main body protective case 4*b*.

As shown in FIGS. 2A and 4, lid body 3 includes convex portion 3*d* (to be referred to as a throat hereinafter) protruding in a direction toward an inner portion (bottom surface) of storage section 4*c*. As shown in FIGS. 2A and 5A, throat 3*d* extends along opening 4*e* of container main body 4. As shown in FIG. 5A, throat 3*d* may be disposed throughout an entire circumference of opening 4*e* or may be disposed along part of the circumference of opening 4*e*. In this exemplary embodiment, as shown in FIG. 2A, throat 3*d* is disposed in contact with circumferential surface (inner circumferential surface) 4*d* of storage section 4*c* of container main body 4 while lid body 3 is closed.

Among paths through which heat enters inside thermally insulated container 1 from outside thermally insulated container 1, an interface in contact with lid body 3 and container main body 4 is regarded as a path that has a largest influence. Disposing throat 3*d* can extend a heat penetration path. This makes it possible to further reduce an influence of penetration of heat from between lid body 3 and container main body 4. Accordingly, it is possible to improve a heat insulation performance of thermally insulated container 1.

While lid body 3 is closed, throat 3*d* faces inner box 5 with a gap between throat 3*d* and inner box 5. That is, throat 3*d* is disposed so as not be in contact with inner box 5 stored in storage section 4*c*. This arrangement can reduce a contact area between inner box 5 and lid body 3, that is, a contact area with thermally insulated container 1, and hence can reduce heat transfer between inner box 5 and thermally insulated container 1. As a result, a heat insulation performance of thermally insulated container 1 improves. In this exemplary embodiment, as described later, heat storage material 5*b* is disposed on wall body 10 of inner box 5, and throat 3*d* is disposed so as not to be in contact with heat storage material 5*b*.

A distal end of throat 3*d* is positioned closer to a bottom portion of storage section 4*c* than an end portion of inner box 5 is, where the end portion is located alongside lid body 3 in storage section 4*c*. This extends a heat-transfer path from container main body 4 to inner box 5 and hence improves the heat insulation performance.

As shown in FIG. 2A, inner box 5 is fixed with an inner box fixing member 6 disposed on a bottom portion of storage section 4*c* of container main body 4. This makes it possible to prevent inner box 5 from moving inside storage section 4*c* due to vibrations at the time of delivery of thermally insulated container 1. In this exemplary embodiment, as shown in FIGS. 2A and 4, inner box fixing member 6 has a concave portion disposed along a shape of a lower portion of inner box 5. With this arrangement, inner box 5 is fitted in inner box fixing member 6 so as to restrict movement of inner box 5 in a horizontal direction.

In this exemplary embodiment, through hole 6*a* is disposed in inner box fixing member 6. More specifically, inner box fixing member 6 is disposed between inner box 5 and the bottom portion of storage section 4*c*, and inner box fixing member 6 has through hole 6*a* extending through from a contact portion with inner box 5 to a bottom portion side of storage section 4*c*. In another words, inner box fixing member 6 has a first surface in contact with inner box 5 and a second surface facing the bottom portion of storage section 4*c*, and inner box fixing member 6 has through hole 6*a* penetrating from the first surface to the second surface. This further reduces a contact area between inner box 5 and inner box fixing member 6, that is, a contact area with the thermally insulated container 1. Accordingly, it is possible to reduce heat-transfer between inner box 5 and thermally insulated container 1.

[3. Inner Box]

Inner box 5 will be described in detail next.

Figure 7:
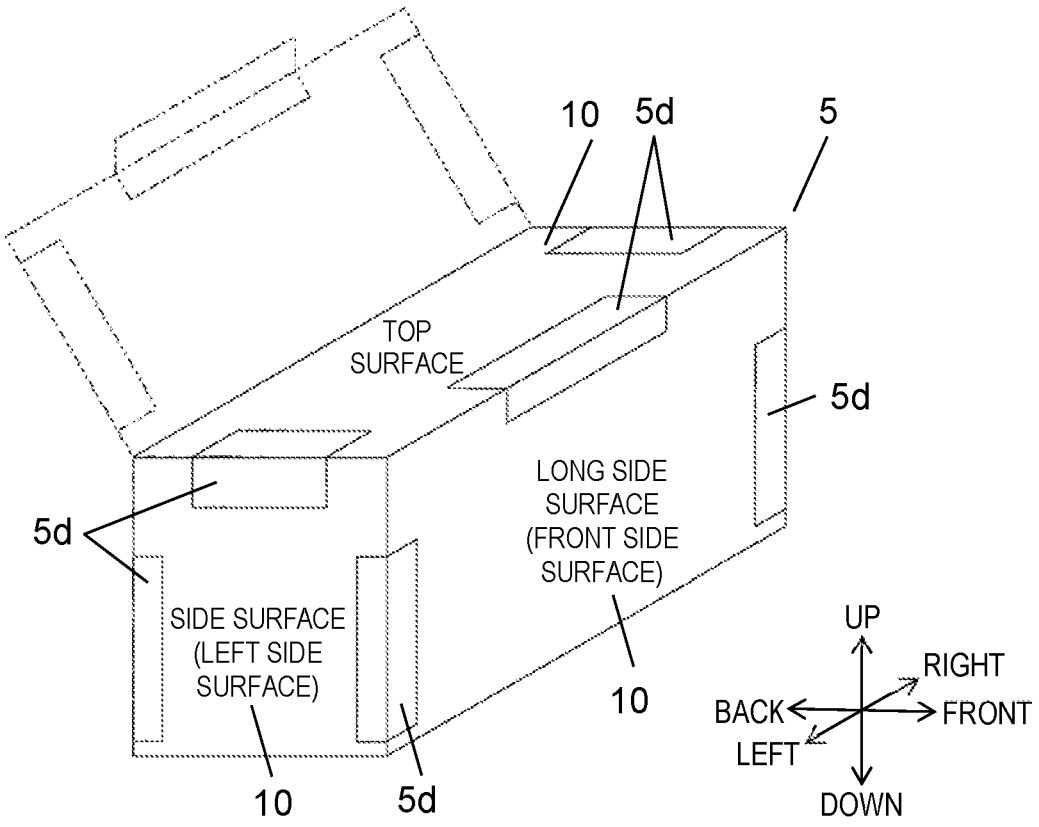
FIG. 7 is a schematic perspective view showing an inner box of the thermally insulated container according to the first exemplary embodiment.
Figure 8:
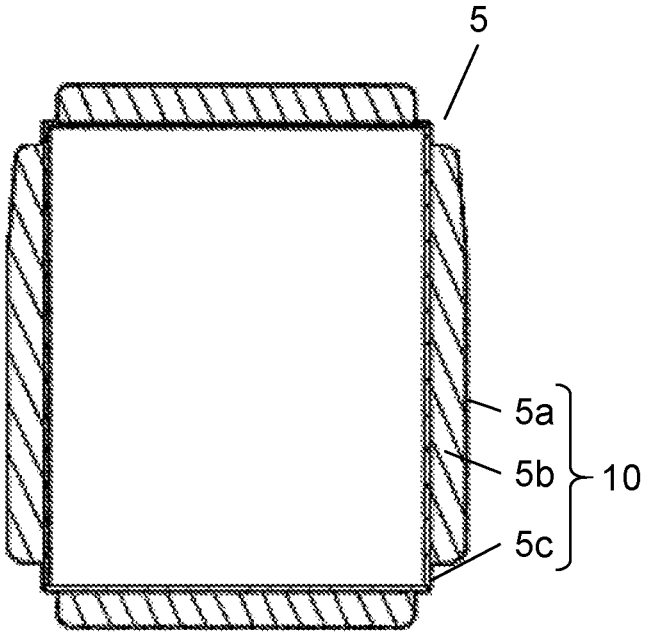
FIG. 8 is a sectional view of the inner box in FIG. 7 when viewed from above.

FIG. 7 is a schematic perspective view showing the inner box of the thermally insulated container according to the first exemplary embodiment. FIG. 8 is a sectional view of the inner box in FIG. 7 when viewed from above.

Inner box 5 has wall body 10. In this exemplary embodiment, as shown in FIG. 7, wall body 10 has a substantially rectangular shape, and inner box 5 has a substantially rectangular parallelepiped shape.

As shown FIG. 8, inner box 5 has an internal space surrounded by wall body 10. A content is stored in this internal space.

Wall body 10 forming inner box 5 includes heat storage material 5*b* and heat-transfer body 5*c*. Heat storage material 5*b* and heat-transfer body 5*c* are stored in packaging member 5*a*.

In this exemplary embodiment, inner box 5 includes six wall bodies 10. Wall bodies 10 are disposed in a box shape to form inner box 5.

As shown in FIG. 8, according to this exemplary embodiment, in an inside of packaging member 5*a*, heat storage material 5*b* is disposed closer to an outer surface of inner box 5 than heat-transfer body 5*c* is. This transfers cooling air from heat storage material 5*b* to an internal space of inner box 5 more uniformly.

Without heat-transfer body 5*c*, cooling air from heat storage material 5*b* flows toward the bottom portion of inner box 5. This increases a difference in temperature between the top surface portion (top surface) and the bottom portion (bottom surface). In this exemplary embodiment, disposing heat-transfer body 5*c* spreads cooling air from heat storage material 5*b* to entire heat-transfer body 5*c*. When air inside inner box 5 comes into contact with heat-transfer body 5*c* via packaging member 5*a*, a temperature of the top surface portion and a temperature of the bottom surface are made uniform, and temperature distributions are reduced. Accordingly, it is possible to keep an internal temperature of inner box 5 uniform.

According to this exemplary embodiment, disposing heat storage material 5*b* at outer surface side of inner box 5 instead of inner surface side of inner box 5 can form an internal space of inner box 5 with flat surfaces. Accordingly, a user can check every corner of the inside of the inner box 5. For example, when heat storage material 5*b* is disposed inside inner box 5, a content (for example, a drug bin) is sometimes hidden behind heat storage material 5*b*, and the user may overlook existence of a content. A reduction in size of a drug bin, in particular, tends to cause such an overlook. However, even if a content is a smaller drug bin, inner box 5 according to this exemplary embodiment is not hidden by heat storage material 5*b*. That is, visibility of an internal space of inner box 5 is high.

In inner box 5 according to this exemplary embodiment, at least a portion of packaging member 5*a* that covers heat storage material 5*b* is formed of a transparent resin. This makes it possible to visually check a state (for example, a degree of melting) of heat storage material 5*b* through packaging member 5*a*.

It is very important, in terms of temperature management, to grasp the degree of melting of a heat storage material. Meanwhile, if the lid of the inner box is opened to check a state of a coolant inside the inner box, a temperature of an internal space of the inner box rises. In addition, opening inner box 5 may apply unnecessary vibrations, light, and the like to a content such as a drug stored in inner box 5.

Inner box 5 according to this exemplary embodiment allows a visual check on the degree of melting of heat storage material 5*b* through packaging member 5*a* without opening inner box 5. Accordingly, this makes it possible to eliminate a feeling of anxiety of a user, feeling that he/she cannot check the degree of melting of heat storage material 5*b*.

As heat-transfer body 5*c*, a metal (for example, aluminum or copper), a resin (for example, polypropylene or ABS resin), or the like can be used. It is preferable to use a material with higher conductivity as heat-transfer body 5*c*.

Figure 9:
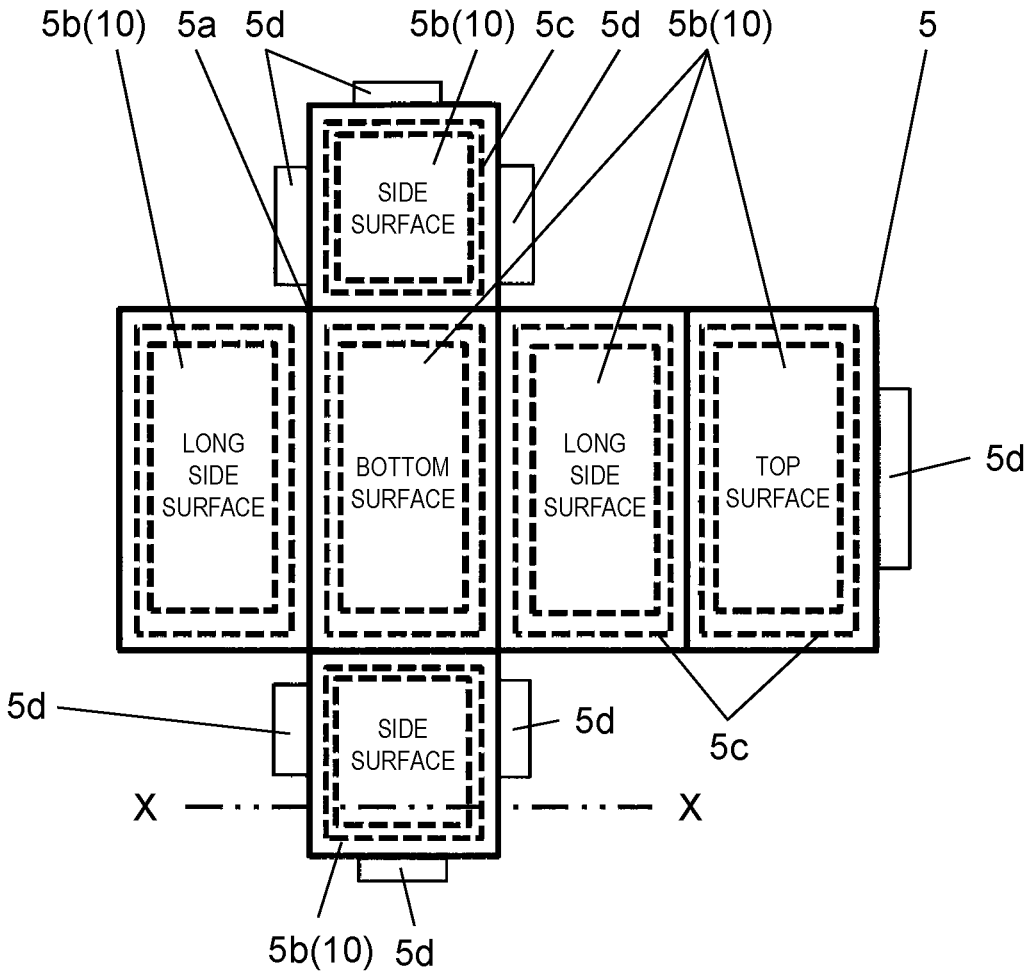
FIG. 9 is a developed view of the inner box in FIG. 7.
Figure 10:
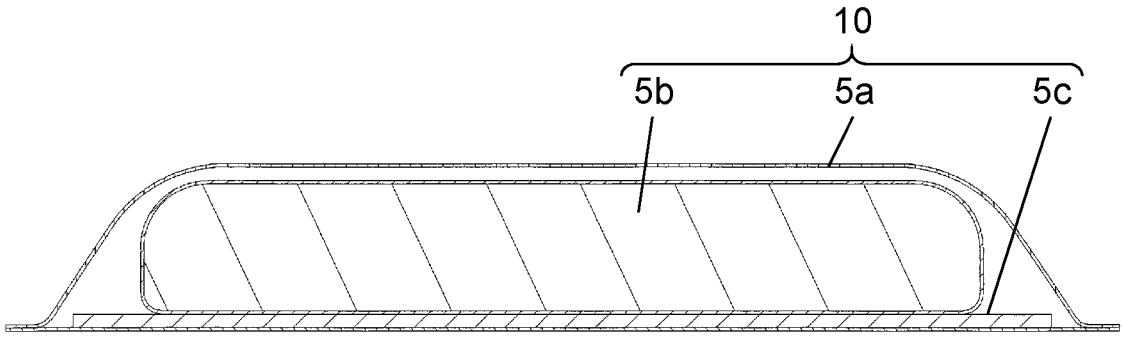
FIG. 10 is a sectional view taken along line X-X of the inner box in FIG. 9.

FIG. 9 is a developed view of the inner box in FIG. 7. FIG. 10 is a sectional view taken along line X-X of the inner box in FIG. 9.

As shown in FIG. 9, heat-transfer body 5*c* according to this exemplary embodiment has a substantially rectangular parallelepiped shape. Heat storage material 5*b* according to the exemplary embodiment has a substantially rectangular parallelepiped shape. As shown in FIGS. 9 and 10, an area of heat-transfer body 5*c* is larger than an area of heat storage material 5*b* when viewed from a thickness direction of wall body 10.

Inner box 5 according to this exemplary embodiment can be folded. Inner box 5 can be developed from a box shape. Adjacent wall bodies 10 are coupled to each other with either packaging member 5*a* of each of adjacent wall bodies 10 or detachable fixing members 5*d*. As shown in FIG. 9, therefore, inner box 5 according to the exemplary embodiment can be easily developed or folded by removing fixing members 5*d*. In addition, developed inner box 5 can be easily assembled.

As fixing members 5*d*, for example, members such as planar tapes or buttons can be used. Sizes of fixing members 5*d*, coupling places of wall bodies 10, and the like can be selected in accordance with weights, thicknesses, and the like of heat storage material 5*b* and heat-transfer body 5*c*.

A heat storage material is generally cooled by a cooling device before use, and is attached to inner box 5 when inner box 5 is used. In this case, inner box 5 according to this exemplary embodiment can be folded while heat storage materials 5*b* are attached to (incorporated in) wall bodies 10.

Figure 11:
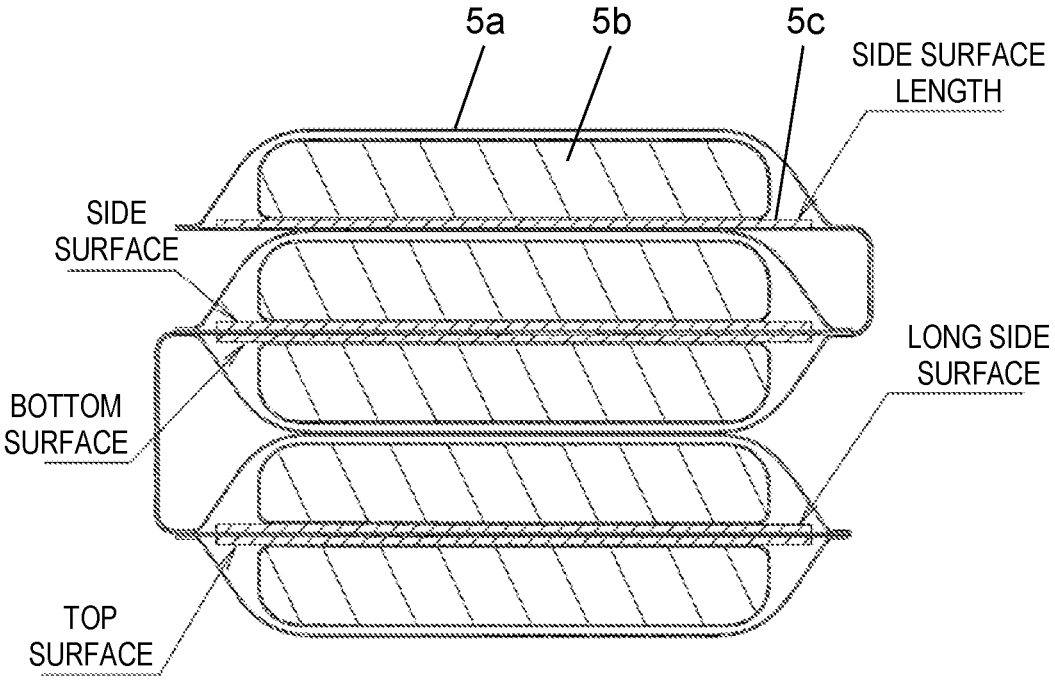
FIG. 11 is a sectional view showing a folded state of the inner box according to this exemplary embodiment.

FIG. 11 is a sectional view showing a folded state of the inner box according to this exemplary embodiment.

As shown in FIG. 11, inner box 5 can be folded such that, for example, heat storage materials 5*b* are stacked and arrayed in a longitudinal direction (vertical direction). When inner box 5 is folded such that heat storage materials 5*b* are arranged two abreast and stacked and arrayed in the longitudinal direction, it is possible to suppress a height of inner box 5 in a folded state. This makes it possible to store inner box 5 in the cooling device even if a strict limitation is imposed on a height of an object that can be stored in the cooling device. As shown in FIG. 9, inner box 5 in a developed state can be placed in the cooling device or a plurality of inner boxes 5 in a developed state can be stacked in the cooling device.

Inner box 5 according to this exemplary embodiment eliminates necessity to take out heat storage materials one by one from packaging members and necessity to store completely cooled heat storage materials one by one in packaging members. This makes it possible to easily and efficiently cool heat storage materials.

Note that an arrangement (for example, an opening portion) for loading and unloading heat storage material 5*b* is not shown in inner box 5. When it is necessary to load and unload a heat storage material, inner box 5 may have an opening portion for loading and unloading heat storage material 5*b*. For example, there may be case in which a heat storage material is selected as appropriate in accordance with a temperature range of a content to be managed or inspection or the like of a heat storage material is performed. An opening portion is disposed in, for example, wall body 10. More specifically, for example, an opening portion may be disposed in packaging member 5*a* so as to open in a top surface direction of inner box 5. In this case, in order to make a temperature inside inner box 5 uniform, contact tightness is desired between heat storage material 5*b* and heat-transfer body 5*c*. Accordingly, when an opening portion is disposed, a fixing member or the like is desired to be disposed near the opening portion so as to close the opening portion. This can maintain or improve contact tightness between heat storage material 5*b* and heat-transfer body 5*c* even when an opening portion is disposed.

Storing inner box 5 in thermally insulated container 1 makes it possible to make an internal temperature of inner box 5 more uniform and maintain the temperature for a long period of time.

Figure 12A:
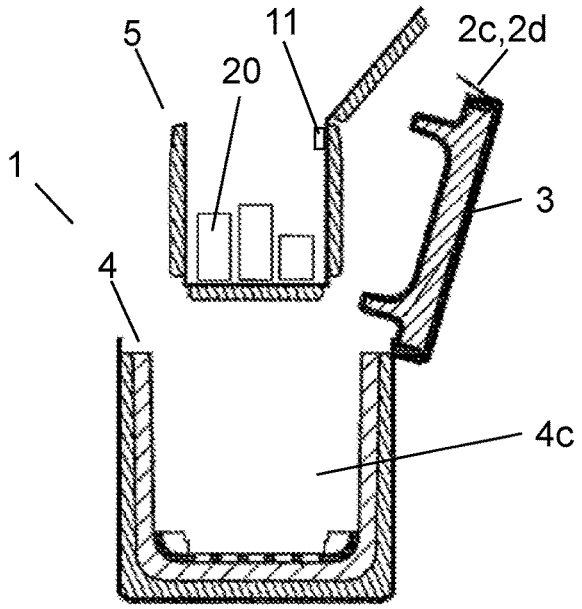
FIG. 12A is a sectional view schematically showing how the inner box in which a content is stored is stored in the thermally insulated container.
Figure 12B:
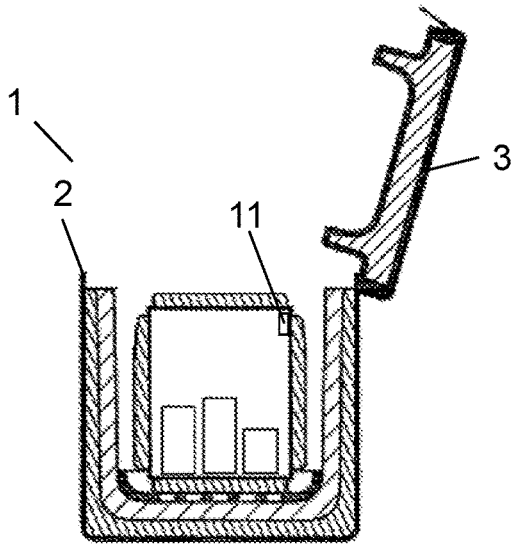
FIG. 12B is a sectional view showing a state where the inner box in which a content is stored and whose top surface is closed is stored in the container main body.
Figure 12C:
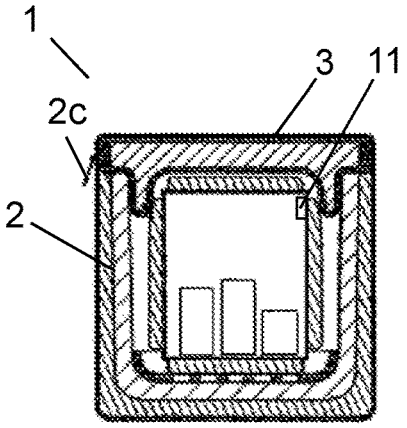
FIG. 12C is a sectional view showing a state where the inner box in which a content is stored is stored in the thermally insulated container and the thermally insulated container is closed with the lid body.

FIGS. 12A to 12C each are a sectional view schematically showing how inner box 5 in which a content is stored is stored in thermally insulated container 1.

As shown in FIG. 12A, thermally insulated container 1 includes container main body 4 and lid body 3. Container case 2 is disposed outside container main body 4. In addition, thermally insulated container 1 includes case fastener 2*c* for closing lid body 3 and container case 2.

As shown in FIG. 12A, inner box 5 in which medicine bottle 20 is stored is stored in storage section 4*c* of thermally insulated container 1. As shown in FIG. 12B, the top surface of thermally insulated container 1 is closed. As shown in FIG. 12C, lid body 3 of thermally insulated container 1 is closed with case fastener 2*c* of container case 2 so as not to be opened.

Note that inner box 5 may have physical quantity sensor 11 (for example, a temperature sensor, a single sensor such as a vibration sensor or optical sensor, or a composite sensor including a vibration sensor and an optical sensor). This makes it possible to record environmental changes in inner box 5 during delivery. When inner box 5 includes a temperature sensor as physical quantity sensor 11, the temperature sensor may be disposed in a region of a temperature distribution in inner box 5 which is regarded as a region with a highest temperature (for example, an upper portion of an inner wall of inner box 5). Inner box 5 may further include a wired or wireless communication means for transmitting data measured by physical quantity sensor 11 to an external device.

When inner box 5 includes a wired communication means, a cable extending from physical quantity sensor 11 may be disposed along the top surface of inner box 5 and routed to outside of inner box 5 through a gap in a coupling portion for coupling adjacent wall bodies 10.

When a wireless communication means is used, a resin member is preferably used as a material for heat-transfer body 5*c* of inner box 5 in consideration of an influence of shielding of electric waves.

Figure 13:
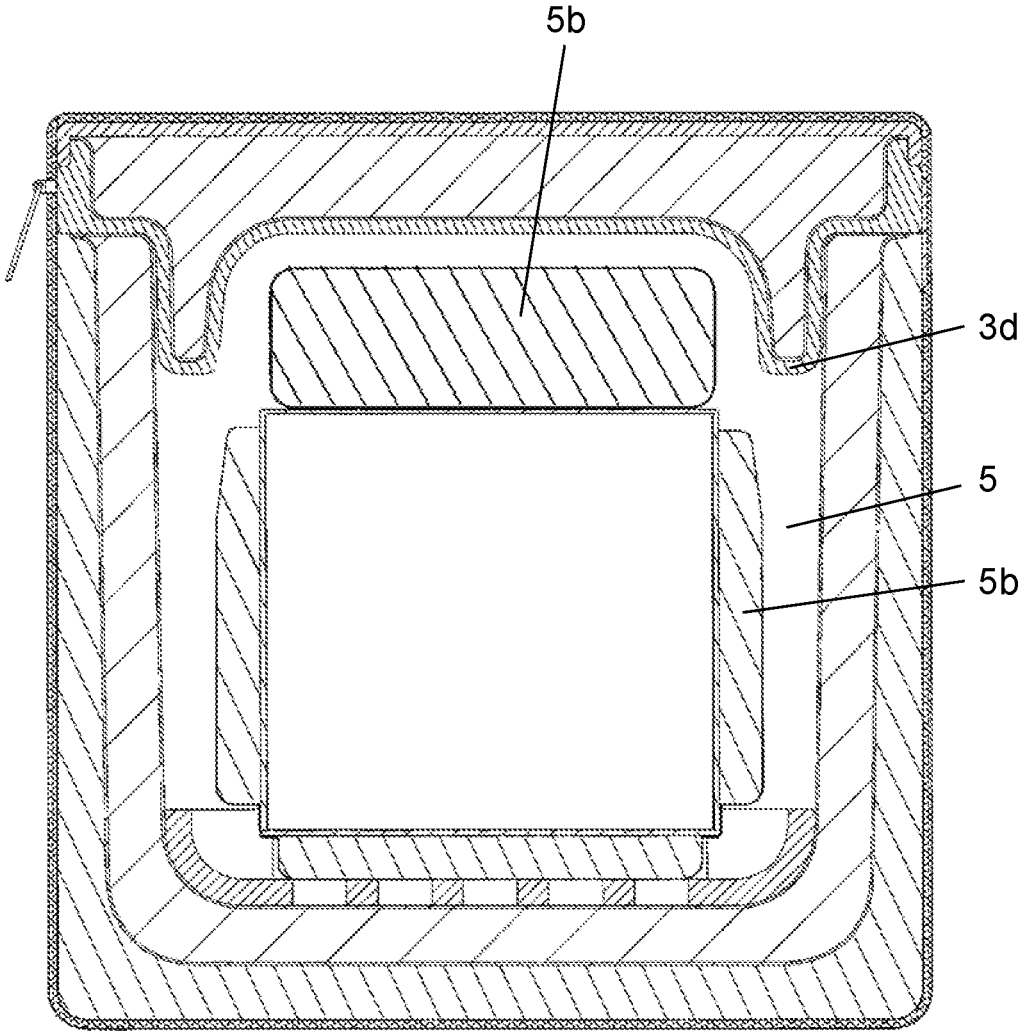
FIG. 13 is a sectional view of a thermally insulated container covered with a container case according to another exemplary embodiment.

Note that an arrangement of throat 3*d* of lid body 3 can be variously modified. In a case shown in FIG. 2A, a side surface of a convex portion forming throat 3*d* faces heat storage material 5*b* disposed on a side portion of inner box 5. That is, a lower end of throat 3*d* is disposed at a position lower than an upper end of heat storage material 5*b* disposed on a side portion of inner box 5. An arrangement of throat 3*d* is not limited to this. For example, as shown in FIG. 13, a side surface of a convex portion forming throat 3*d* may face heat storage material 5*b* disposed on the top surface of inner box 5.

In each of these cases, a heat-transfer path of heat from an outside of thermally insulated container 1 is maximally elongated, and throat 3*d* and heat storage material 5*b* are positioned in a contactless relationship. This makes it possible to improve a heat insulation performance of thermally insulated container 1.

As described above, the present disclosure can improve a heat insulation performance. This makes it possible to widely apply the present disclosure to applications requiring heat retention. For example, the present disclosure can be applied to applications of storage or delivery of an investigational drug, blood, or specimen, which requires a storage environment in a specific temperature range.

What is claimed is:

1. A thermally insulated container comprising:

a container main body having a storage section and an opening;

a lid body that covers the opening of the container main body; and an inner box stored in the storage section, wherein the lid body has a convex portion, the convex portion being arranged along a periphery of the opening of the container main body and protruding toward an inside of the storage section when the lid body covers the opening, the convex portion faces the inner box, with a gap between the convex portion and the inner box when the lid body covers the opening, the inner box includes a wall body having a packaging member, and a heat-transfer body and a heat storage material that are stored in the packaging member, the heat-transfer body and the heat storage material each being a separate member from the packaging member, the heat storage material is disposed closer to an outer surface of the inner box than the heat-transfer body is, and the inner box is not in contact with a side of the storage section of the container main body.

2. The thermally insulated container according to claim 1, wherein the convex portion comes into contact with an inner peripheral surface of the storage section when the lid body covers the opening.

3. The thermally insulated container according to claim 1, wherein a distal end of the convex portion is positioned closer to a bottom portion of the storage section than an end portion of the inner box is, when the lid body covers the opening and the convex portion is located in the storage section.

4. The thermally insulated container according to claim 1, further comprising at least two wall bodies adjacent to each other, the at least two wall bodies each being the wall body, and the at least two wall bodies are coupled to each other, at each one side adjacent to each other, with at least one of a detachable fixing member and the packaging members of the at least two wall bodies.

5. The thermally insulated container according to claim 1, wherein a portion of the packaging member that covers the heat storage material is a transparent resin.

6. The thermally insulated container according to claim 1, further comprising a physical quantity sensor disposed inside the inner box.

7. The thermally insulated container according to claim 1, further comprising an inner box fixing member configured to fix the inner box, the inner box fixing member being disposed at a bottom portion of the storage section of the container main body.

8. The thermally insulated container according to claim 7, wherein the inner box fixing member is a separate member from the container main body and is in contact with the side of the storage section of the container main body.

9. The thermally insulated container according to claim 1, wherein the heat-transfer body has a plate shape.

10. The thermally insulated container according to claim 1, wherein in a planar view of the wall body, the heat-transfer body is larger than the heat storage material.

11. The thermally insulated container according to claim 1, wherein at least one of the container main body and the lid body comprises a vacuum heat insulating housing.

12. A thermally insulated container comprising:

a container main body having a storage section and an opening;

a lid body that covers the opening of the container main body;

an inner box stored in the storage section; and an inner box fixing member configured to fix the inner box, the inner box fixing member being disposed at a bottom portion of the storage section of the container main body, wherein the lid body has a convex portion, the convex portion being arranged along a periphery of the opening of the container main body and protruding toward an inside of the storage section when the lid body covers the opening, the convex portion faces the inner box, with a gap between the convex portion and the inner box when the lid body covers the opening, the inner box is not in contact with a side of the storage section of the container main body, the inner box fixing member is disposed between the inner box and a bottom portion of the storage section, and has a first surface in contact with the inner box and a second surface facing the bottom portion of the storage section, and the inner box fixing member has a through hole penetrating from the first surface to the second surface.

13. The thermally insulated container according to claim 12, wherein the inner box fixing member is a separate member from the container main body, and the second surface of the inner box fixing member is in contact with the bottom portion of the storage section of the container main body.

14. The thermally insulated container according to claim 12, wherein the through hole is hollow.

15. The thermally insulated container according to claim 12, wherein the through hole is one of a plurality of through holes.

* * * * *